United States Patent [19]

Bursk

[11] 4,034,511

[45] July 12, 1977

[54] WEATHER STRIPPING CONSTRUCTION FOR METAL COVERED DOOR

[75] Inventor: William M. Bursk, Middletown, Ohio

[73] Assignee: Pease Company, Fairfield, Ohio

[21] Appl. No.: 640,199

[22] Filed: Dec. 12, 1975

[51] Int. Cl.[2] ..... E06B 7/16

[52] U.S. Cl. ..... 49/488; 49/489; 49/495

[58] Field of Search ..... 49/488, 489, 495, 482, 49/501

[56] References Cited

U.S. PATENT DOCUMENTS

| | | | |
|---|---|---|---|
| 417,178 | 12/1889 | Hartley | 49/488 |
| 3,386,209 | 6/1968 | Starcevic | 49/488 X |
| 3,690,037 | 9/1972 | Kempel | 49/468 X |
| 3,750,333 | 8/1973 | Vance | 49/488 X |

*Primary Examiner*—Kenneth Downey
*Attorney, Agent, or Firm*—Biebel, French & Nauman

[57] ABSTRACT

A door comprising a rectangular frame covered by sheet metal skins is provided on its under edge with special weather stripping which includes clip means serving to mount the weather stripping in cooperation with flange portions along the under edges of the metal skins which are turned under the door frame to form return wings. The cooperative relation of the weather stripping and the return wings makes it possible to mount the weather stripping on a door in hung position by sliding it endwise into place. The return wings also offer the further advantage of improved fire protection.

1 Claim, 5 Drawing Figures

WEATHER STRIPPING CONSTRUCTION FOR METAL COVERED DOOR

BACKGROUND OF THE INVENTION

U.S. Pat. No. 3,153,817 discloses a door comprising a rectangular frame composed of wooded stiles and top and bottom rails to which is applied a pair of metal skin covering each face of the frame. Side flanges on the metal skins overlap the stiles to hold the skins on the frame, but the skins terminate at the top and bottom of the frame. The practice in the past has been to cover the otherwise exposed surface of the bottom rail with weather stripping for sealing engagement with a sill in the closed portion of the door.

In the past, it has been customary with doors of this type, as well as with other doors, to use weather stripping on the under edge of the door which could be applied only with the door removed from its frame, and replacement of such weather stripping when worn or damaged is difficult and time consuming, in that it also requires removal and rehanging of the door. In addition, with the weather stripping previously available for sheet metal covered doors, it was not practical to carry the metal skins around the bottom edge of the door frame.

SUMMARY OF THE INVENTION

This invention provides weather stripping for a metal covered door which has two outstanding advantages. It can be removed and replaced without taking down the door, and it makes it possible and practical to carry the metal skins partially around the bottom edge of the door frame for improved sealing and fire resistance.

In a door according to the invention, the metal skins are provided with flange portions along their lower edges which form return wings proportioned to extend under a minor outer edge portion of the under surface of the bottom rail, thus leaving an exposed strip therebetween. The weather stripping of the invention includes a main strip which completely covers the bottom edge of the door, and this strip has on its upper surface a pair of lip members which cooperate therewith to form a clip structure for cooperation with the return wings on the skins to mount the weather stripping in place.

The weather stripping of the invention is mounted in position by sliding it endwise along the bottom edge of the door, after threading the end edges of the return wings into the pair of outwardly opening slots defined by the lip members and the upper surface of the weather stripping. Preferably, the bottom edge of the door is grooved to receive the lip members. The upper surface of the weather stripping is preferably also provided with an upwardly extending fin which can act as a barrier to the passage of moisture transversely of the door between the weather stripping and any part of the door frame.

DESCRIPTION OF THE PREFERRED EMBODIMENT

Figure 1:
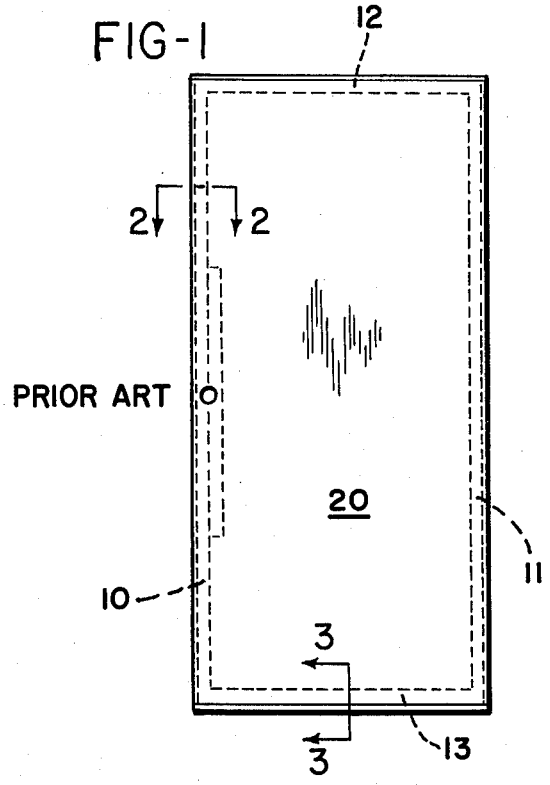
FIG. 1 is an elevation showing a door generally of the construction disclosed in 3,153,187.

The door shown in FIG. 1 comprises a pair of side stiles 10 and 11, and top and bottom rails 12 and 13 all of wood, the spaces between the rails and stiles being preferably filled with plastic foam 15 or other filler material.

Figure 2:
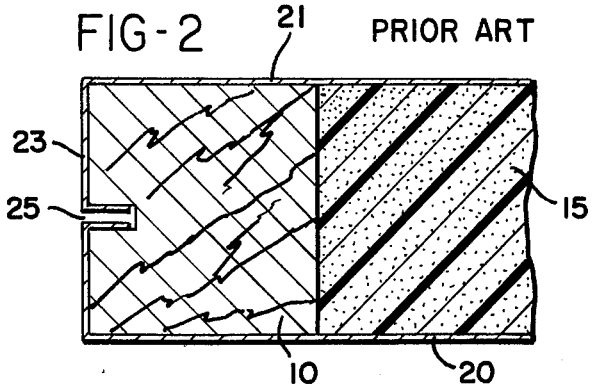
FIG. 2 is an enlarged fragmentary section on the line 2—2 of FIG. 1.

Metal skins 20 and 21 cover the surface of the door frame of FIG. 1. As shown in FIG. 2, the metal skins 20 and 21 including side flanges 22 and 23 respectively which overlap the stile 10 and include edge flanges which are received in space relation in a groove 25 in the outer surface of stile 10, the spaced relation of the edge flanges in the slot 25 providing a thermal break for retarding transfer of heat and cold between the two skins. As shown in patent 3,513,857, this construction is duplicated at the other stile 11.

Figure 3:
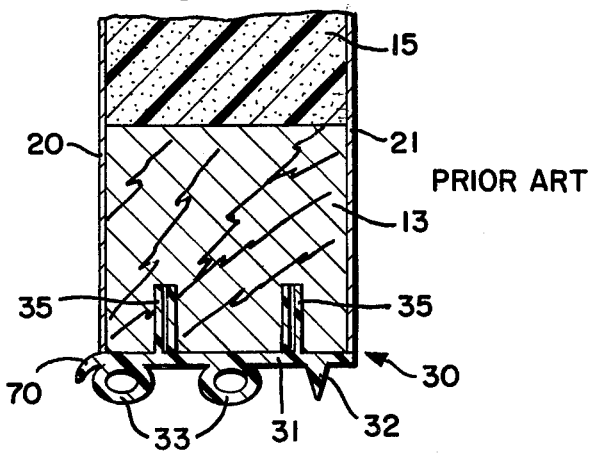
FIG. 3 is an enlarged fragmentary section on the line 3—3 of FIG. 1 showing conventional prior art weather stripping on a door of the construction shown in FIG. 1.

In the conventional construction as shown in FIG. 3, the metal skins terminate at the bottom edge of the door frame, leaving the entire bottom surface of bottom rail 13 exposed. This surface has in the past been provided with weather stripping 30 comprising a main strip 31 provided on its under surface with a fin 32 and a pair of compressible tube portions 33. Mounting of the strip in position was accomplished by inserting a pair of barbed fins 35 on its upper surface into complementary grooves in the rail 13, and it was also found necessary to secure the weather stripping 30 in position by means of staples or nails driven through the strip 31 into the rail. This operation could obviously be accomplished only with the door out of its frame to leave its bottom edge exposed.

Figure 4:
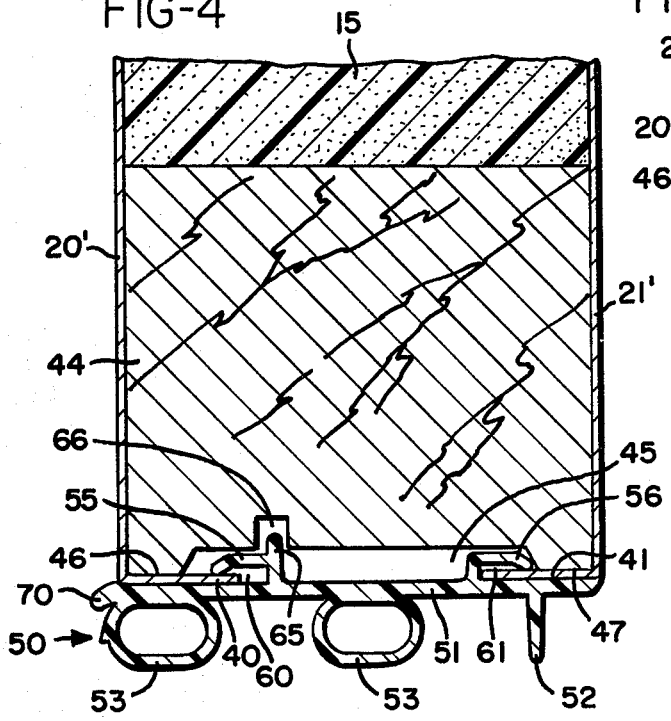
FIG. 4 is a view similar to FIG. 2 showing weather stripping in accordance with the invention on the bottom rail of a door generally of the construction shown in FIG. 1.

The door and weather stripping in accordance with the invention as shown in FIG. 4 includes flange portions 40 and 41 on the skins 20' and 21' which extend around the under surface of the bottom rail 44 to form return wings. Instead of being flat as in FIG. 3, this rail surface comprises a longitudinal groove 45 of a width which is equal to more than one-half the thickness of the rail, leaving only a relatively narrow land 46, 47 along each edge of the bottom of the rail which is approximately one-half the width of the adjacent return wing 40 or 41.

Figure 5:
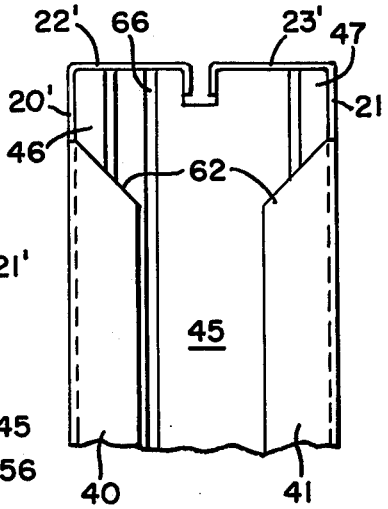
FIG. 5 is a fragmentary view of the underside of the door of FIG. 4 with the weather stripping removed.

The weather stripping 50 of the invention includes a main strip 51 which covers the entire bottom surface of the door and also includes on its under surface a fin 52 and a pair of compressible tube portions 53. On the upper surface of the strip 51 is a pair of lip members 55 and 56 which define clip means for mounting the weather stripping on the door. These lip members extend outwardly to define a pair of slots 60 and 61 positioned to receive the edge portions of the return wings 40 and 41 which project inwardly beyond the lands 46 and 47, and the ends of these projecting wing portions are relieved and beveled, as shown at 62 in FIG. 5, to converge inwardly to facilitate insertion of the weather stripping 50, which is retained after insertion by the flange portion 22' and 23' of the metal skins 20' and 21'.

The weather stripping 50 can be manufactured from any suitable plastic, e.g. vinyl chloride, and for preferred results, the stip 51 and lip members 55 and 56 should be relatively rigid, while the fin 52 and compressible tube portion 53 should be more elastomeric for ready deflection or compressibility. Satisfactory results from this standpoint have been obtained by forming weather stripping 50 as a coextrusion of suitable vinyl compounds.

It will be noted that as in the prior construction shown in FIG. 3, the outside edge of the weather stripping 50 projects beyond the front face of the door and includes a downwardly turned lip 70 which tends to cause water running down the front face of the door to drip onto the sill rather than to seep between the wing 40 and the strip 51. If such seepage should occur, the upwardly extending fin 65 along the inner edge of the lip member 55, which is received in a complementary groove 66 in the bottom of the rail 44, acts as an indexing member and also as a barrier minimizing the possibility of the transfer of moisture between the strip 51 and the rail 44 from one side of the door to the other.

While the product herein described constitutes a preferred embodiment of the invention, it is to be understood that the invention is not limited to this precise product, and that changes may be made therein without departing from the scope of the invention.

What is claimed is:

1. A door adapted for use as the exterior door of a dwelling or the like, comprising:

a. rectangular frame means including a bottom rail, b. a separate sheet material skin covering each side of said frame means, c. means securing said skins to the side edges of said frames, d. said skins including substantially horizontal flange portions along the bottom edges thereof overlapping the bottom surface of said bottom rail, e. said flange portions being dimensioned to extend inwardly towards one another less than one-half the width of said rail surface and thereby to provide an exposed strip of said surface, f. weather stripping means underlying said rail surface and said flange portions and including:

1. a main strip proportioned to cover said bottom rail surface and in sealing engagement with the bottom outside surfaces of said flange portions,

2. a pair of lip members extending along the top of said main strip and cooperating therewith to define outwardly opening slots,

3. said flange portions being received in said slots for cooperation with said lip members to attach said weather stripping means to said rail, and

4. compressible means on the bottom side of said main strip for sealing engagement with a cooperating door sill, g. said bottom rail surface further including a relatively narrow horizontally disposed land along each edge thereof and a lengthwise groove between said lands for receiving said lip members, said flange portion beings of sufficiently greater width than said lands to project therebeyond below said groove for reception in said slots defined by said lip members and said main strip; and h. an upwardly projecting fin on one of said lip members forming a barrier to flow of moisture past said lip member, and means forming a supplemental groove in said rail surface for receiving said fin.

* * * * *